US009666062B1

(12) United States Patent
Rachal

(10) Patent No.: US 9,666,062 B1
(45) Date of Patent: May 30, 2017

(54) EMERGENCY ALERT SYSTEM

(71) Applicant: Frank G. Rachal, Manassas, VA (US)

(72) Inventor: Frank G. Rachal, Manassas, VA (US)

( * ) Notice: Subject to any disclaimer, the term of this patent is extended or adjusted under 35 U.S.C. 154(b) by 0 days.

(21) Appl. No.: 14/956,343

(22) Filed: Dec. 1, 2015

(51) Int. Cl.
*G08B 25/01* (2006.01)

(52) U.S. Cl.
CPC ..... *G08B 25/016* (2013.01)

(58) Field of Classification Search
CPC combination set(s) only.
See application file for complete search history.

(56) References Cited

U.S. PATENT DOCUMENTS 3,567,158 A * 3/1971 Coyle ..... B64D 17/32 24/602
6,270,916 B1 8/2001 Sink et al.
7,586,289 B2 9/2009 Andruk et al.
8,086,306 B2 12/2011 Katzman et al.
2004/0113780 A1 6/2004 Pottratz
2012/0312247 A1 12/2012 Ebersole
2014/0361895 A1 12/2014 Smith
2015/0117948 A1 4/2015 Carlson
2015/0258315 A1 9/2015 Chandler et al.

FOREIGN PATENT DOCUMENTS

GB 2492091 A 12/2012

OTHER PUBLICATIONS

"Weatherproof Personal Alarm with Rip Cord Activation and Attachment Utility Strap," Amazon websit.
"Personal locator beacon (PLB)," Nautic Expo website.

* cited by examiner

*Primary Examiner* — Kabir A Timory
(74) *Attorney, Agent, or Firm* — Richard C. Litman

(57) ABSTRACT

The emergency alert system may include a device/emergency kit container, or may be incorporated into a belt, harness, or other personal protective equipment. The system may include a zipper slider, a zipper, access tab, alert device, and non-conductive pull tab. When the non-conductive pull tab is pulled, the alert device is triggered, and alerts monitors that an emergency situation has occurred involving traumatic injury and alerting the monitors of the location of the emergency situation.

15 Claims, 4 Drawing Sheets

EMERGENCY ALERT SYSTEM

BACKGROUND OF THE INVENTION

1. Field of the Invention

The present invention relates to emergency alert devices and systems, and more particularly to an emergency alert system that provides a switch-actuated emergency alert device for providing or summoning assistance to a person or a location.

2. Description of the Related Art

Trauma, regardless of its source (gunshots, stabbings, serious falls, car accidents, natural disasters, etc.) is the leading cause of death among Americans under the age of forty-five, accounting for more fatalities than illness and infectious disease combined. Emergency first responders have developed a protocol to handle traumatic injuries, which includes early recognition, early treatment, and quick access to a medical facility. In particular, the time required to summon an emergency first responder to the scene of a traumatic injury is critical. The survival rate in traumatic injuries is substantially related to emergency response time. A few minutes may make the difference between life and death. While various systems have been developed for summoning assistance to the elderly who live alone, such systems are often geographically circumscribed to the person's home and require verbal communication with an intermediary security or monitoring service to determine the nature of the situation for which assistance is needed. A faster alert system that can accommodate younger individuals and is flexible enough for use in outdoor emergencies or activities, regardless of location, is needed.

Thus, an emergency alert system solving the aforementioned problems is desired.

SUMMARY OF THE INVENTION

The emergency alert system may include a device/emergency kit container, or may be incorporated into a belt, harness, or other personal protective equipment. The system may include a zipper slider, a zipper, access tab, alert device, and non-conductive pull tab. When the non-conductive pull tab is pulled, the alert device is triggered, and alerts monitors that an emergency situation has occurred involving traumatic injury and alerting the monitors of the location of the emergency situation.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
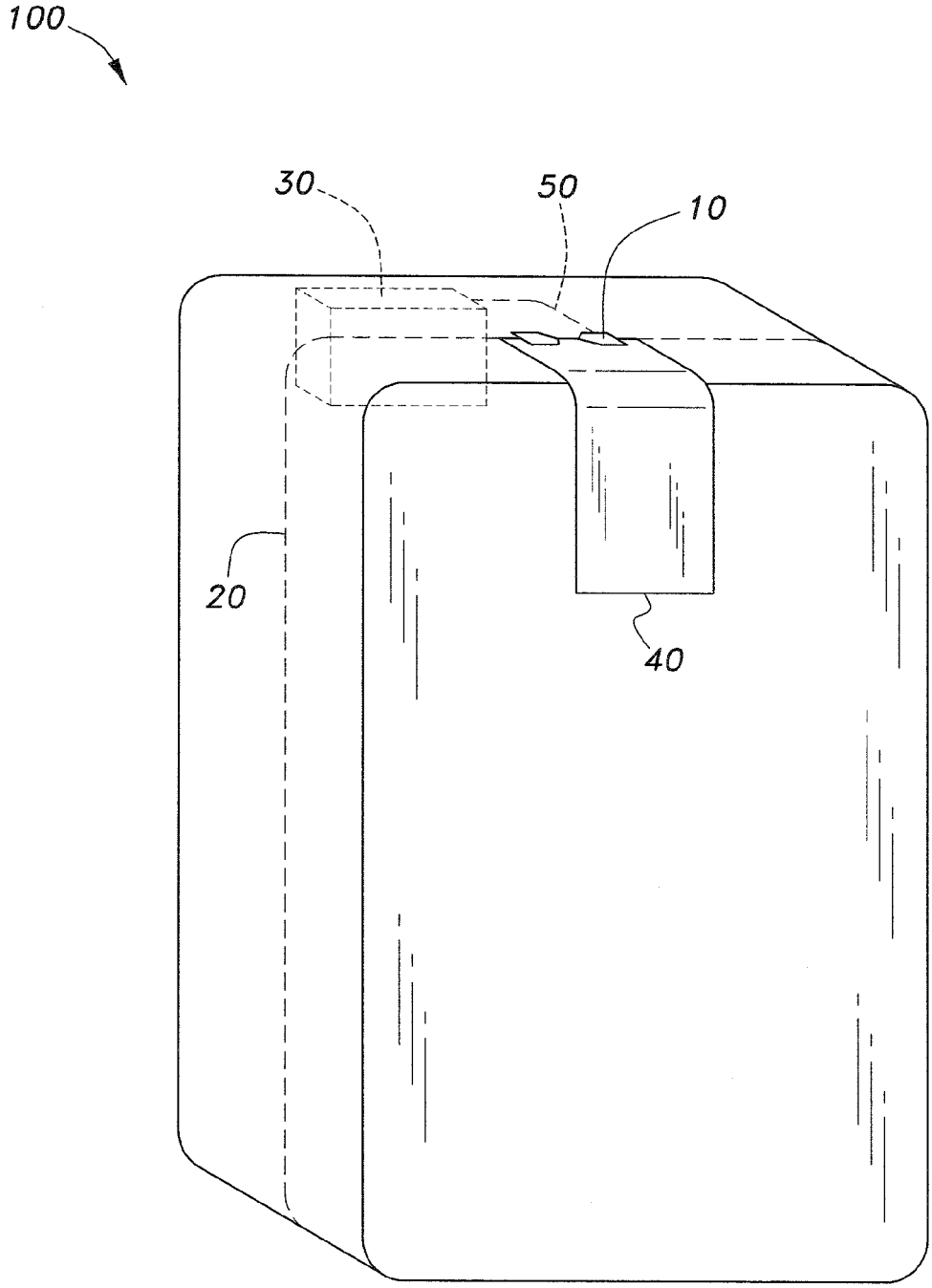
FIG. 1 is an environmental, perspective view of an exemplary embodiment of an emergency alert system according to the present invention.

The emergency alert system 100 (an example of which is shown in FIG. 1) may include a device/emergency kit container that includes a zipper slider 10, a zipper 20, access tab 40, alert device 30 and non-conductive pull tab 50.

Figure 2A:
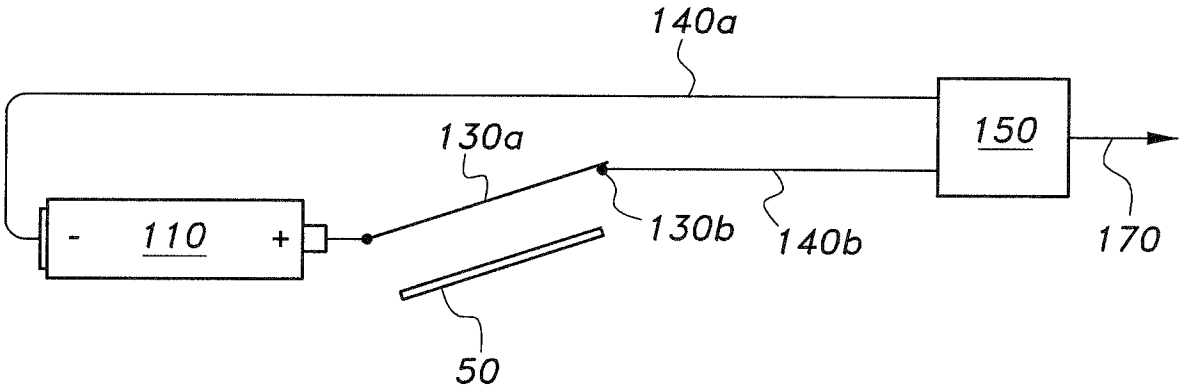
FIG. 2A is an exemplary schematic diagram an electronic circuit of an alert device for an emergency alert system according to the present invention, showing the switch closed to activate the alert.
Figure 2B:
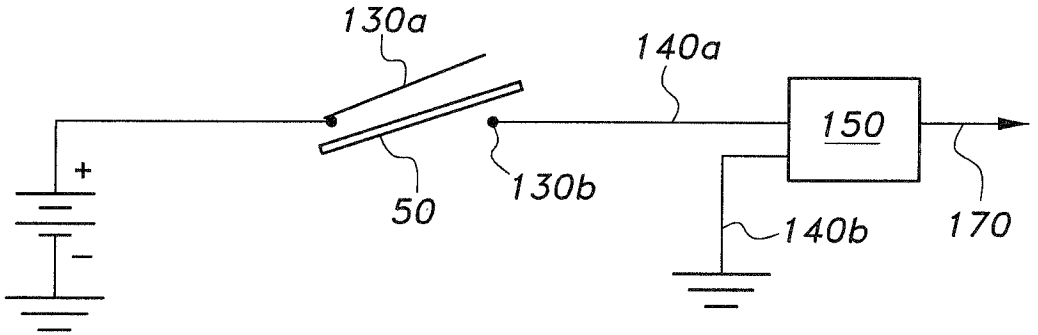
FIG. 2B is an exemplary schematic diagram of the electronic circuit of FIG. 2A, showing the switch open to inactivate the alert.

As shown in FIGS. 2A and 2B, a battery-operated circuit may include a battery 110 having its negative terminal connected to a first lead 140*a* and a spring biased switch throw 130*a*. A switch pole 130*b* is connected to a second lead 140*b*. The first and second leads 140*a* and 140*b* are connected to a device 150 that is actuated when the battery-operated circuit is closed. The non-conductive pull tab 50 is removably disposed between the switch throw 130*a* and pole 130*b*, thus keeping the circuit open until the non-conductive pull tab is pulled away from the switch throw 130*a* and switch pole 130*b* mechanism. The open configuration of the battery operated circuit is shown in FIG. 2B, where the pull tab 50 is disposed between the switch throw 130*a* and the switch pole 130*b*.

The closed configuration of the battery operated circuit is shown in FIG. 2A, where the pull tab 50 is removed from the switch mechanism (spring-biased switch throw 130*a* and switch pole 130*b*). In this configuration, the circuit is closed and the device 150 is actuated to send a signal over line 170.

When the battery-operated circuit is activated, it sends out an emergency signal over signal line 170 to a remote location, such as a central station, police station, paramedic service or other emergency responders. The emergency signal may also include identifying information about the location of the emergency using conventional circuitry, such as a global positioning system (GPS), or may transmit a beacon that can be triangulated. The emergency signal or beacon may be modulated with a message, either digital or analog, signifying that trauma has occurred and emergency response is required. In the event that the alert device incorporates a GPS receiver, the circuit may be configured so that the battery continuously supplies power to the GPS receiver, the switch being interposed between the battery and the alert transmitter, beacon, or transponder. The signal 170 may be transmitted using a radio that generates an RF signal, a cell phone signal, or other known communication signals.

The pull tab 50 may be attached to the door of an emergency response kit, such that the circuit is activated when the door of the kit is opened. Alternatively, the pull tab 50 may be attached to the door of a compartment built into the housing of the kit or attached to a zipper of a pocket that houses the alert device and is attached to the kit, so that the kit may be opened without activating the alert device when needed to treat minor abrasions that do not require emergency response. In another alternative, the pull tab 50 may be directly pulled by a user if the circuit is mounted on a wearable article, such as a harness, belt or other piece of apparel.

Figure 3:
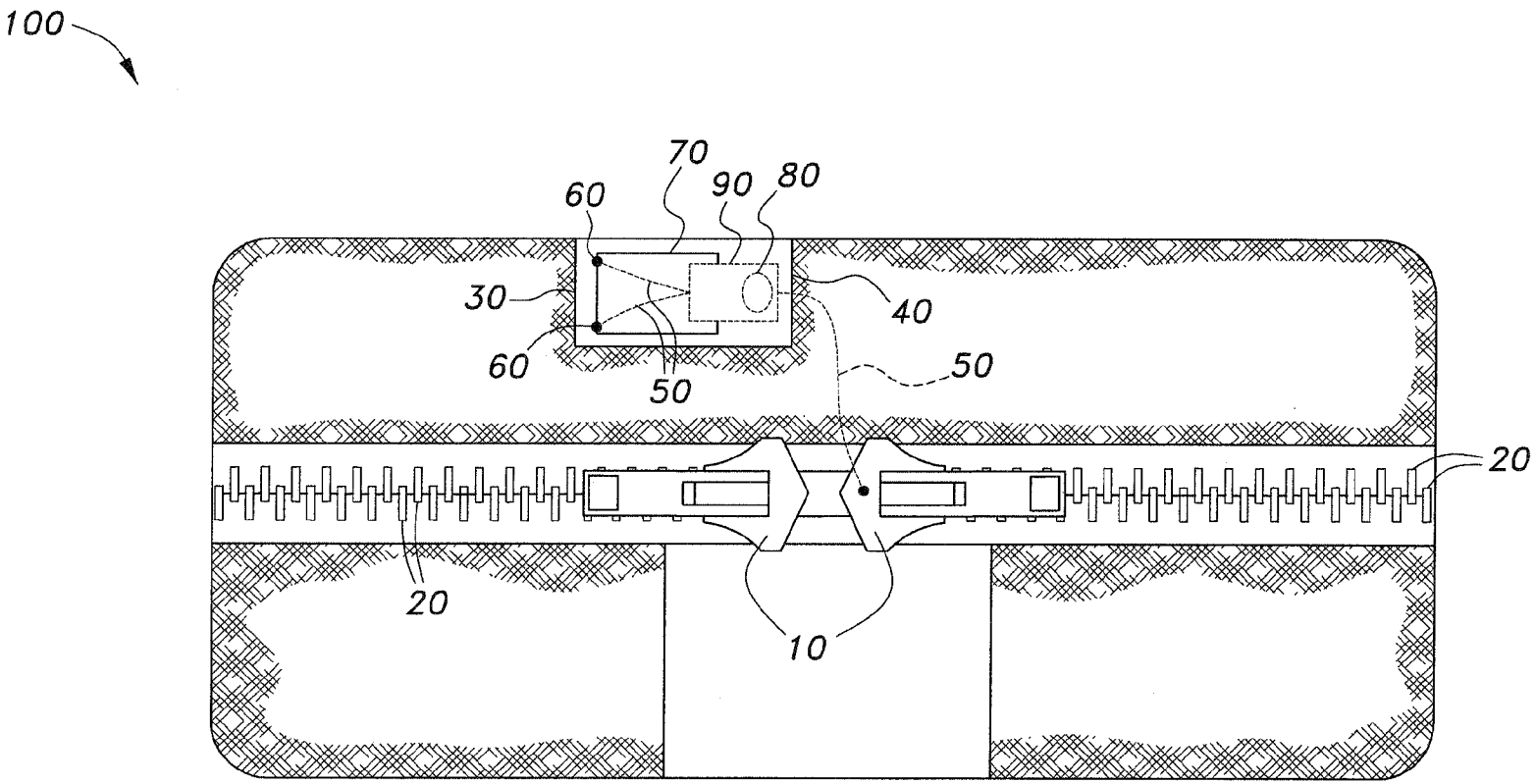
FIG. 3 is a top view of an alternative embodiment of an emergency alert system according to the present invention.

In the embodiment shown in FIG. 3, attachment points 60 are disposed on a device 70. A pull cord 50 is attached to the attachment points 60 and is tied to a left side of a guide 90 for a pre-staged power source 80. The cord resumes and is attached to a right side of guide 90, extending to a zipper slider 10, and is hooked up to the device 70 via the pull tab 50. When the zipper travels along the zipper 20, the pull cord travels with the zipper slider 10, pulling the guide 80, thereby allowing the pre-staged power source 80 to close a circuit, such as the circuit shown in FIGS. 2A and 2B.

The emergency alert system 100 functions as a trauma indicating system. The system/device may identify that an individual has sustained a trauma injury and that time is of the essence. The device 150 may be registered, and once activated, emits a signal via signal line 170 to an emergency communications center or tactical operations command. (In one embodiment, it is up to command or an emergency communications officer to send an alert out for emergency responders).

The emergency alert system 100 may utilize an identifier having a registered number to its owner. In the event that the identifier is activated, the emergency alert system 100 will send/e-mail the identifier via a signal over signal line 170 to an emergency communication center or tactical operations command or emergency operations command. The device 150 shall have a pre-staged power source to energize the system 100.

Figure 4:
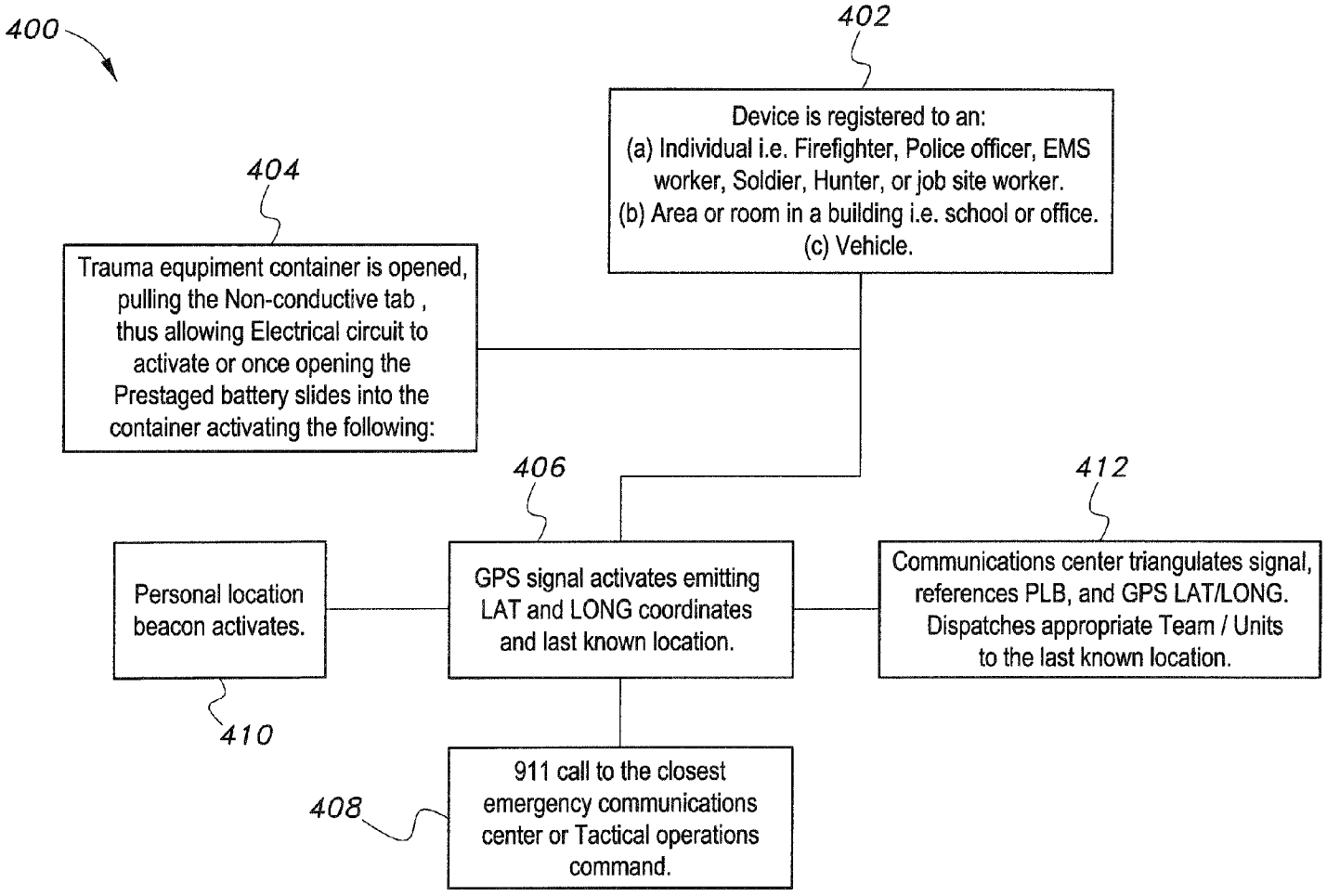
FIG. 4 is a flowchart of an emergency alert system according to the present invention.

As shown in FIG. 4, at step 402, the device 150 may be registered to an individual or a location. At step 404, when the container of the system 100 is opened, the battery-operated circuit sends an activation signal. In addition to the activation procedure shown in FIGS. 2A and 2B, a pre-staged battery may be positioned to slide into the container to complete the battery operated circuit, thereby activating the device 150. At step 406, the activation signal may activate a GPS signal emitting present coordinates and last known location. At step 410, a personal location beacon activates. At step 412, a communications center triangulates the signal, references a personal locator beacon (PLB) and/or GPS lat/long, and dispatches a response team as appropriate. At step 408, a 911 call to a closest emergency communications center is initiated.

It is to be understood that the present invention is not limited to the embodiments described above, but encompasses any and all embodiments within the scope of the following claims.

I claim:

1. An emergency alert system, comprising:

a device/emergency kit container;

a zipper track disposed on the kit container;

a zipper slider disposed on the zipper track for opening and closing the kit container;

a non-conductive pull tab connected to the zipper slider;

an access tab disposed on the kit container and connected to the non-conductive pull tab;

an electronic device disposed inside the kit container;

a battery operated circuit disposed inside the kit container and operably connected to the electronic device;

a spring-biased electrical switch included in the battery-operated circuit, the spring biased electrical switch energizing the electronic device when the spring-biased electrical switch is closed, the non-conductive pull tab being disposed between a switch pole and a switch throw arm of the switch, thereby keeping the electrical switch open until the non-conductive pull tab is pulled; and wherein when the access tab is pulled and the zipper is slid along the zipper track, the non-conductive pull tab is removed from between the switch pole and switch throw arm, the switch throw arm being spring-biased to close the switch, thereby completing the battery-operated circuit to activate the electronic device.

2. The emergency alert system according to claim 1, further comprising a signal line forming an output of the electronic device, the signal line allowing a signal to be transmitted from the electronic device to a remote location.

3. The emergency alert system according to claim 2, wherein the signal transmitted from the electronic device is a hard-wired signal.

4. The emergency alert system according to claim 2, wherein the signal transmitted from the electronic device is a wireless signal.

5. The emergency alert system according to claim 2, wherein the signal transmitted from the electronic device is a wireless signal including identifying information about the location of the emergency.

6. An emergency alert system, comprising:

a compartment attached to a portable accessory, the compartment having an access opening and an actuator for opening and closing the access opening;

an alert device disposed in the compartment, the alert device having a circuit including a power source, a switch having contacts, and a transmitting circuit configured for transmitting an alert signal when power is applied from the power source to the transmitting circuit; and a pull tab connected between the actuator and the switch, the pull tab being disposed between the switch contacts to maintain the switch in an open position when the access opening to the compartment is closed, thereby disconnecting power from the power source to the transmitting circuit, the pull tab being pulled from between the switch contacts when the actuator opens the access opening in the compartment, thereby closing the switch and applying power to the transmitting circuit to transmit the alert signal.

7. The emergency alert system according to claim 6, wherein said actuator comprises a door to the compartment.

8. The emergency alert system according to claim 6, wherein said actuator comprises a zipper fastener of the compartment.

9. The emergency alert system according to claim 6, wherein said actuator comprises a pull cord.

10. The emergency alert system according to claim 6, wherein said portable accessory comprises a belt.

11. The emergency alert system according to claim 6, wherein said portable accessory comprises a harness.

12. The emergency alert system according to claim 6, wherein said portable accessory comprises a first aid kit.

13. The emergency alert system according to claim 6, wherein said portable accessory comprises an emergency response kit.

14. The emergency alert system according to claim 6, wherein said alert signal comprises a beacon capable of being triangulated to determine location of the compartment.

15. The emergency alert system according to claim 6, wherein said alert device further comprises a GPS receiver, said transmitting circuit being configured for transmitting geographic coordinates determined by the GPS receiver in the alert signal.

* * * * *